United States Patent [19]

Takahara et al.

[11] 4,456,909

[45] Jun. 26, 1984

[54] METHOD AND CIRCUIT FOR SELECTIVELY DRIVING CAPACITIVE DISPLAY CELLS IN A MATRIX TYPE DISPLAY

[75] Inventors: Kazuhiro Takahara, Akashi; Keizo Kurahashi, Kobe; Hisashi Yamaguchi, Hyogo, all of Japan

[73] Assignee: Fujitsu Limited, Kawasaki, Japan

[21] Appl. No.: 278,715

[22] Filed: Jun. 29, 1981

[30] Foreign Application Priority Data

Jun. 30, 1980 [JP] Japan ..... 55-89590
Jul. 17, 1980 [JP] Japan ..... 55-98291
Aug. 19, 1980 [JP] Japan ..... 55-114515

[51] Int. Cl.[3] ..... G09G 3/04

[52] U.S. Cl. ..... 340/781; 340/805; 340/825.81; 315/169.3

[58] Field of Search ..... 340/781, 825.81, 766, 340/805, 789; 315/169.3, 169.1

[56] References Cited

U.S. PATENT DOCUMENTS 3,311,781 3/1967 Duinker et al. ..... 340/825.81
3,343,128 9/1967 Rogers ..... 340/781
3,765,011 10/1973 Sawyer et al. ..... 340/825.81
4,152,626 5/1979 Hatta ..... 340/781
4,349,816 9/1982 Miller et al. ..... 340/781

OTHER PUBLICATIONS

*DMOS Raster-Scan Plasma Panel Drivers,* Oleszek et al., IBM Tech. Discl. Bull., vol. 21, #3, 8/78; pp. 1096–1098.

*Cost Reduced Gas Panel Drive System;* Martin; IBM Tech. Discl. Bull., vol. 19, #9, 2/77; pp. 3457–3458.

*Primary Examiner*—Marshall M. Curtis
*Attorney, Agent, or Firm*—Staas & Halsey

[57] ABSTRACT

A method for driving a thin film EL display device comprising the steps of clamping the Y side scanning electrodes selectively and sequentially to a reference voltage and applying the display voltage selectively from the X side data electrodes. In addition, the non-display voltage which is lower than the display threshold voltage, is applied to the non-selected data electrodes and the non-selected scanning electrodes are floated. This new driving method reduces drive power and widens the device operating voltage range.

13 Claims, 23 Drawing Figures

METHOD AND CIRCUIT FOR SELECTIVELY DRIVING CAPACITIVE DISPLAY CELLS IN A MATRIX TYPE DISPLAY

BACKGROUND OF THE INVENTION

1. Field of the Invention

This invention relates to an improved method for driving a matrix type display device where the capacitive display cells are arranged in the form of a matrix, and particularly to an excellent method for driving a display panel such as a thin film EL display device with a low driving power and wide operation margin.

2. Description of the Prior Art

Well known as a matrix type display device comprising capacitive display cells arranged in the form of a matrix, is a display panel having the structure that the scanning electrodes and data electrodes are arranged in orthogonal directions from in both sides of the display medium such as the EL (electroluminescence) substance or discharge gas respectively via the insulation layer. Generally, so-called AC refresh drive is employed for driving such a display panel, but since many half-selected display cells are connected to the selection electrodes in both scanning and data sides, the driving power must have a capacity so as to charge the capacitance of these half-selected display cells.

However, the power consumed for charging such half-selected display cells is completely unnecessary for display and therefore such power must be reduced as much as possible.

The conventional EL display device will be explained in more detail from the point of view of such problem.

BRIEF DESCRIPTION OF THE DRAWINGS

FIGS. 2*a*, 2*b* and 2*c* show the electrode voltage waveforms applied to the display cells and the voltages applied to the display area, of a conventional drive method;

FIG. 1(*a*) is the sectional view indicating an ordinary structure of a thin film EL display device, where the transparent scanning (or data) electrode 2 is laid in the Y direction on the glass substrate 1, the EL layer (electro lumicescence layer) 4 is placed thereon via the insulating layer 3, and the rear surface data (or scanning) electrode 6 is placed thereon in the direction of X via the other insulating layer 5. Thus, as shown in FIG. 1(*b*), the capacitive display cell 7 is defined at each intersecting point of the scanning electrode 2 and the data electrode 6. The desired display can be obtained by applying the refresh pulse in common from the Y side scanning electrode 2 after repeating the operation of applying the drive pulse corresponding to the data to be displayed to said selection lines in parallel from the side of data electrode 6, in such a condition that the Y side scanning electrodes 2 are sequentially selected one by one.

However, when applying the drive pulse, as shown in FIG. 2(*a*) to the electrode arrangement of FIG. 1(*b*), a voltage in such a level as a half of the required light emitting level Va is respectively applied to the selected data electrode Xa and selected scanning electrode Ya, and during such period, the non-selected data electrode Xna and non-selected scanning electrode Yna are clamped to the reference voltage (ground potential). Therefore, the combined voltage as shown in FIG. 2(*b*) is applied to the display cells formed at the intersecting points of electrodes, and when a value of required light emitting level Va to be applied to the cells of selected ponts Xa-Ya is considered, for example, as 200 V, the voltage of 100 V is also applied to the cells of the half-selected points Xna-Ya and Xa-Yna and resultingly a discharge current corresponding to such voltage is applied thereto.

Moreover, it may be possible to drive the panel while the non-selected electrodes are placed in the floating condition in view of lowering the difference between voltages to be applied to the half-selected points as explained above. But this method results in the problem that an erroneous display is more likely to occur at the half-selected points or non-selected points on the selected scanning electrodes as the number of selected data electrodes increases, compared with the total number of data electrodes, and since the upper limit of voltage pulse to be applied to the selected data electrodes is strictly defined, the drive voltage margin is narrow.

SUMMARY OF THE INVENTION

It is an object of the present invention to provide a method for driving a matrix type display device comprising capacitive display cells, such as an EL display device, with a low drive power and a wide voltage margin and in addition without any erroneous display.

More practically, it is an object of the present invention to provide a method of driving a display panel which successfully reduces unnecessary power consumption at the half-selected points and non-selected points of the EL display device and which simultaneously assures stable drive without erroneous display in relation to the increase or decrease of selected points, thereby realizing a high reliability and low cost of a driving circuit.

Briefly, the present invention is characterized by the timing of supplying the display drive voltage level Va to the selected data electrodes under the condition that the selected scanning electrodes are clamped to the reference voltage, and the non-display voltage in such a level Vna which is insufficient for giving the display effect is applied to the non-selected data electrodes and simultaneously the non-selected scanning electrodes are sustained at the voltage higher than the reference voltage. As a result, since the scanning electrodes connected to the display cells of half-selected points and non-selected points are placed in such a condition as having a very high impedance while the drive voltage is being applied, unnecessary discharge current is drastically reduced.

DETAILED DESCRIPTION OF THE PREFERRED EMBODIMENTS

Figure 1A:
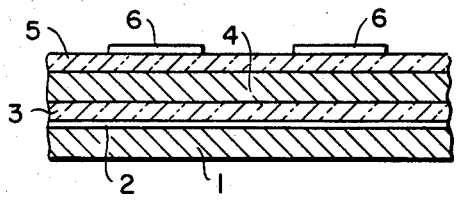
FIGS. 1*a* and 1*b* show the general structure and electrode arrangement of an EL display apparatus.
Figure 1B:
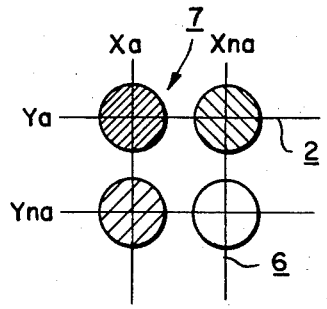
Figure 2:
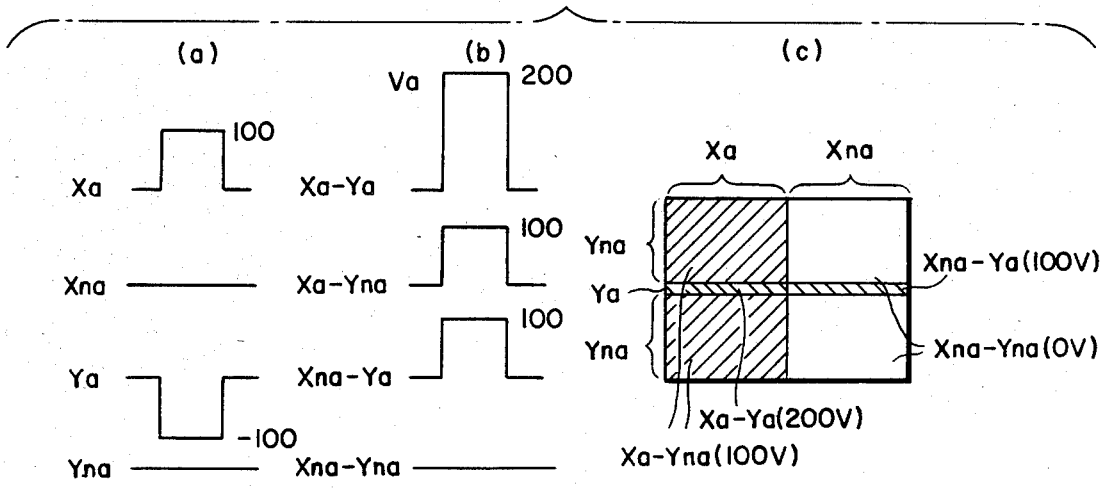
FIG. 2(*c*) shows a profile on the display screen of the voltage levels which are respectively applied to the selected area Xa-Ya, half-selected areas Xa-Yna and Xna-Ya, and non-selected area Xna-Yna in such a case that the scanning electrode Ya is selected in a certain scanning timing and simultaneously a half of the data electrodes are selected. As will be understood from this figure, as the number of selected data electrodes increases, the unnecessary power consumption at the half-selected points increases accordingly.
Figure 3:
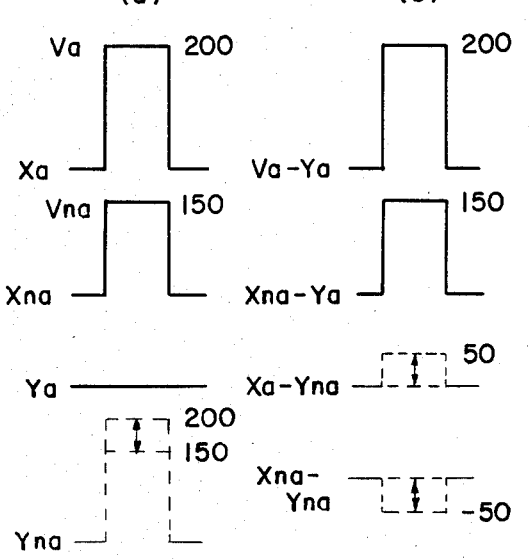
FIGS. 3*a* and 3*b* show the voltage waveforms applied to the electrodes of the display cells in accordance with the method of the present invention.
Figure 4:
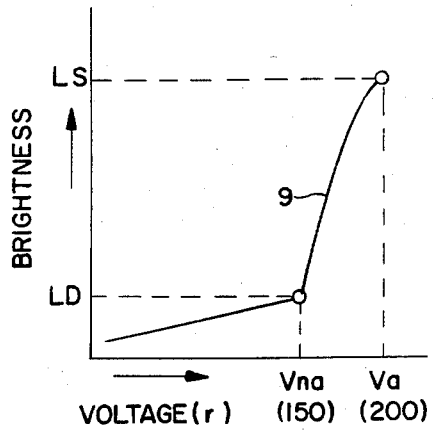
FIG. 4 indicates the brightness characteristics of an EL display apparatus.

FIGS. 3(*a*), (*b*) respectively show the waveforms of voltages applied to the electrodes and voltages applied to the display cells in order to realize a method for driving the display device of the present invention. Here, considered as an example is the thin film EL display device as explained previously in FIG. 1. In the case of such example, the brightness characteristic rapidly rises at an applied voltage of about 150 V as indicated by the curve 9 of FIG. 4 and saturates at a voltage of about 200 V.

Therefore, in regard to FIG. 3(*a*), according to the present invention, the non-selected scanning electrodes Yna, except for the grounded selected scanning electrode Ya, are floated while the display drive voltage Va of 200 V is applied to the selected data electrode Xa, and on the other hand, the non-display voltage Vna of 150 V is applied to the non-selected data electrode Xna. The voltage Vna of 150 V applied to the non-selected data electrodes is given as the display threshold voltage corresponding to the points of LD which is insufficient brightness to give the display effect due to the brightness characteristic of FIG. 4 explained above and the display drive voltage Va of 200 V is set in the same way as the voltage giving the saturated brightness LS indicated in FIG. 4. In addition, the voltage of the non-selected scanning electrode Yna maintained in the floating condition, floats within the range from 200 V to 150 V in accordance with the number of selected data electrodes.

Thus, as is obvious from FIG. 3(*b*), when the display drive voltage of 200 V is applied to the display cells of selected points Xa-Ya on the selected scanning lines, the non-display voltage of 150 V is applied to the half-selected points Ya-Xna on said scanning line, namely on the selected scanning electrode Ya, but only the maximum of 50 V is applied in accordance with the floating voltage of non-selected scanning electrodes applied to the cells of the half-selected points Xa-Yna on the selected data electrode Xa which occupy the majority of the remaining cells and the cells of non-selected points Xna-Yna.

Figure 5:
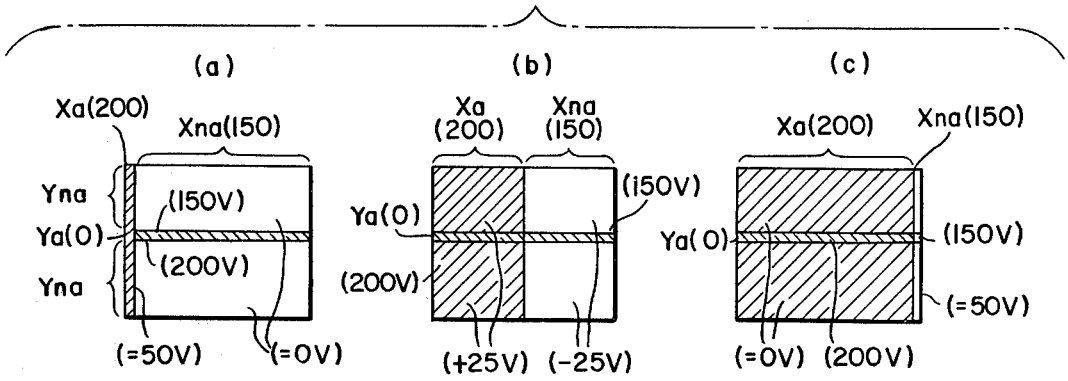
FIGS. 5*a*, 5*b* and 5*c* graphically illustrate voltages applied to each area of the display screen in accordance with the number of selected data electrodes.

FIGS. 5(*a*), (*b*) and (*c*) show the relation of voltages applied to the cells in the areas on the display screen in accordance with the number of selected data electrodes. In case where only one data electrode Xa is selected as shown in FIG. 5(*a*), the potential of the non-selected scanning electrode Yna, in the floating condition, becomes almost 150 V in accordance with the clamp voltage of the non-selected data electrodes Xna, and although a voltage difference of 50 V is generated at the half-selected points on the selected data electrode, no effective voltage is applied to the cells of non-selected points Xna-Yna which occupy the majority of the display screen.

In the case of FIG. 5(*b*) a half ($\frac{1}{2}$) of the data electrodes are selected, wherein since the floating potential of the non-selected scanning electrode Yna comes close to 175 V depending on the voltage 200 V of the selected data electrodes and the 150 V of the non-selected data electrodes, a voltage of about 25 V is actually applied to the display cells of the half-selected points Xa-Yna and non selected points Xna-Yna. Moreover, FIG. 5(*c*) shows the condition where only one data electrode is in the non-selected condition. In this case, the floating voltage of the non-selected scanning electrodes rises up to about 200 V in accordance with the voltage of selected data electrodes and no voltage is actually applied to the cells of half-selected points Xa-Yna connected thereto. Therefore, according to the present invention, the unnecessary power consumption is maximum during half selection as shown in FIG. 5(*b*), but the effect of reducing power consumption is distinctive as compared with the conventional method since such maximum value is at most only a discharge current due to a voltage difference of about 25 V.

In the case a majority of data electrodes are selected as in the case in FIG. 5(*c*), if the remaining non-selected data electrodes Xna are clamped to 0 V, the floating voltage of the non-selected scanning electrodes Yna rise up to about 200 V as explained above. Therefore a voltage of about 200 V is also applied to the non-selected points between Xna-Yna, thus generating an erroneous display. However, when the non-display voltage Vna lower than the display threshold value, is applied to the non-selected data electrodes Xna according to the present invention, only a voltage of at most Va-Vna (50 V in this case) is applied to the non-selected points and therefore a risk of causing erroneous display can be eliminated even in case the display voltage Va is increased in the range such that a value of Va-Vna is kept within the level of Vna. In other words, in an example shown in the figure, even when the display voltage Va is boosted up to 300 V, a voltage of only 150 V is applied to the non-selecting points and resultingly an erroneous display does not occur, thus providing much wider margin of display voltage.

Figure 6:
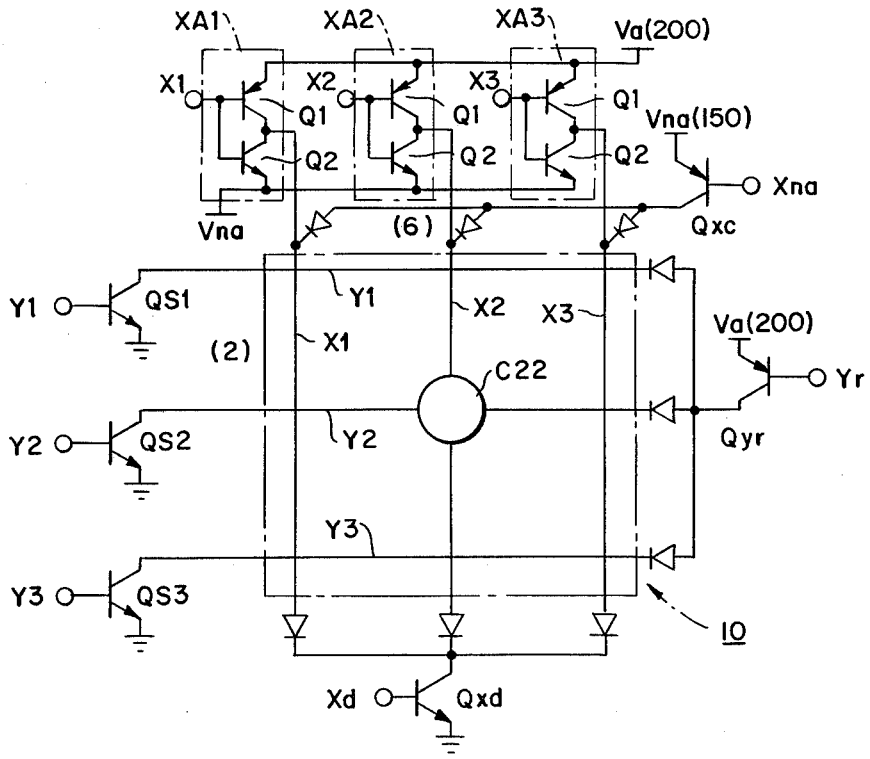
FIG. 6 illustrates an example of a circuit for executing the drive method of the present invention.

FIG. 6 outlines an example of a circuit structure for realizing the drive as explained above. Where, the electrodes $Y_1$ to $Y_3$ of the Y side scanning electrode group 2 of the EL display device 10, explained previously with regard to FIG. 1, are connected with the scanning transistors QS1 to QS3 for selective grounding. On the other hand, these electrodes are connected in common with the transistor $Qy_r$ for supply the refresh pulse via the diode for signal separation.

Meanwhile, in regard to the X side data electrode group 6, the electrodes $X_1$ to $X_3$ are connected with the address drivers XA1 to XA3 comprising the pnp and npn transistors pairs $Q_1$, $Q_2$ which are connected in series between the display level Va of 200 V and the non-display level Vna of 150 V. Moreover, to this data electrode group, the transistor $Q_{xc}$ for clamping to the non-display voltage Vna and the transistor $Q_{Xd}$ for grounding are connected respectively in common via the diode for separation.

Figure 7A:
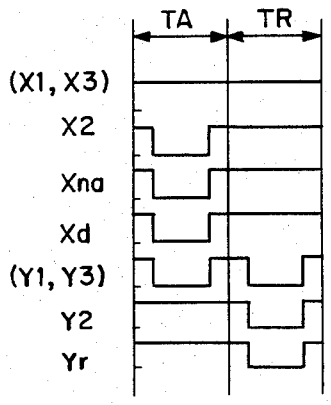
FIGS. 7*a*, 7*b* and 7*c* show the input signal waveforms, waveforms applied to electrodes, and waveforms applied to the display cells for the circuit of FIG. 6.
Figure 7B:
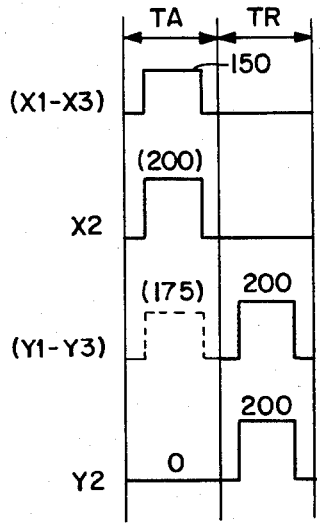
Figure 7C:
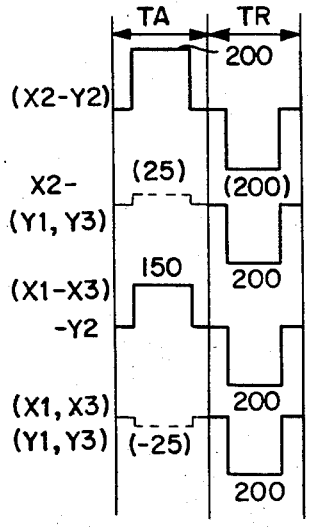

For the actual driving, the AC refresh driving method as explained first is employed. Namely, the scanning for a single display frame is carried out by sequentially applying the address signal for each line. Thereafter, the addressed points emit the light when the refresh pulse is applied in common from the side of scanning electrodes. FIG. 7(*a*) shows the input signal waveforms in the address period TA and refresh period TR for the driver and transistor for causing the display cell $C_{22}$ at the intersecting point of the scanning electrode $Y_2$ and data electrode $X_2$ to emit light. In the same figure, the waveforms are given the codes which are also given to the corresponding input terminals. FIG. 7(*b*) shows the waveforms applied to the electrodes, while FIG. 7(*c*) shows the voltage waveforms applied to respective display cells.

With reference to FIG. 6 and FIG. 7, when the display cell $C_{22}$ at the intersecting point of the scanning electrode $Y_2$ and the data electrode $X_2$ is selected, the display drive pulse of 200 V is applied to the selected cells from the transistor $Q_1$ of address driver XA2 to the scanning transistor $QS_2$. At this time, in the scanning electrode side, all of the non-selected scanning electrodes $Y_1$, $Y_3$ are placed in the floating condition with a high impedance due to the OFF condition of scanning transistors $QS_1$, $QS_3$. On the other hand, the non-selected electrodes on the data electrode side are clamped to the non-display voltage of 150 V respectively via the non-selected address drivers the diodes and the clamp transistor $Q_{xc}$. Therefore, a charging current accordance with to the floating voltage flows into the stray capacitance of the non-selected scanning electrodes, flows into the half-selected points on the selected data electrode $X_2$ from the drive power source of 200 V of the address driver XA2. In the same way a charging current, which enters the non-selected data electrodes via the non-selected scanning electrodes $Y_1$, $Y_3$, in the floating condition, from the selected data electrode $X_2$ and goes to the power source of 150 V through the transistor $Q_2$ in the low voltage side of non-selected address drivers XA1, XA3 connected to the data electrodes, flows into the display cells of the non-selected points. However, the charging or discharging current flows into these half-selected points and non-selected points, depending only on a voltage difference of about only 25 V and therefore the power loss is comparatively low.

On the other hand, when the driving method as explained above is employed, it is desirable to reduce voltage to be switched by the driving circuit elements that form the address drive circuit on the data electrode side element of the floating power supply system.

Figure 8:
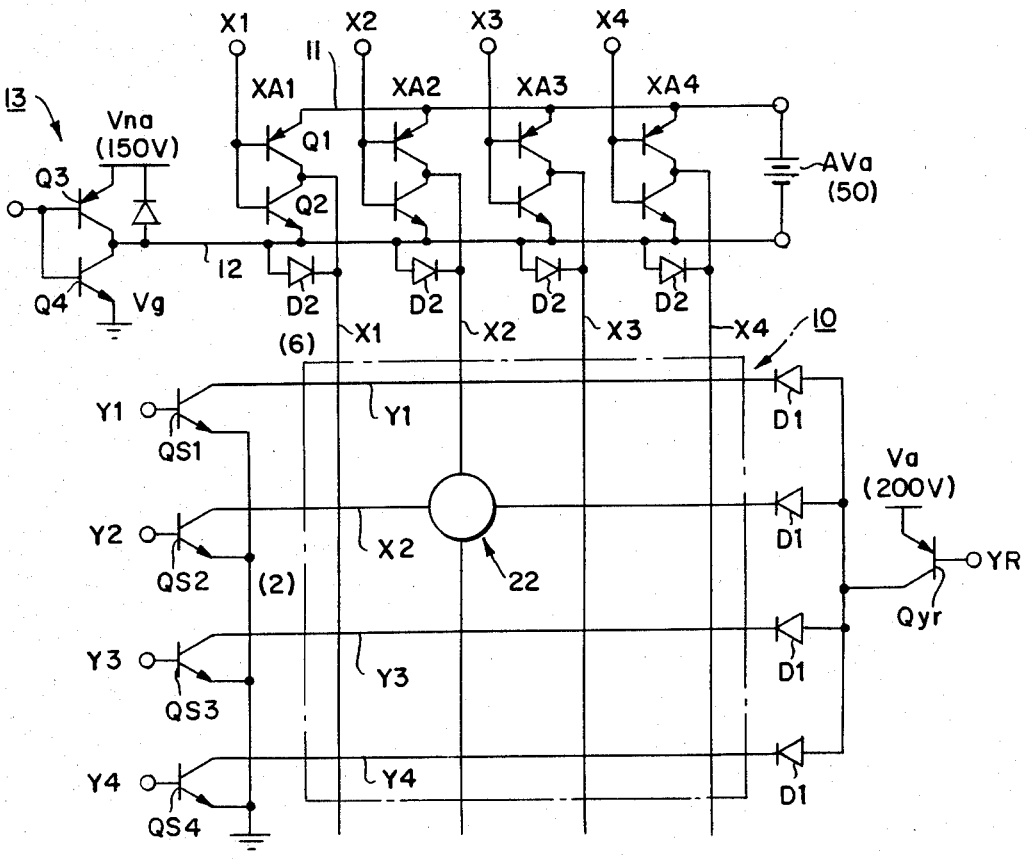
FIG. 8 is a second embodiment of the drive method of the present invention.

FIG. 8 shows the structure of such a drive circuit. In the this figure, the electrodes $Y_1$ to $Y_4$ of the Y side scanning electrode group 2 of the thin film EL display device 10 are respectively connected to the transistors QS1 to QS4 for selective grounding as the scanning drivers and also connected, in common with the refresh pulse supply transistor $Q_{yr}$ via the separation diode $D_1$.

The X side data electrode group 6 is respectively connected, to each electrode $X_1$ to $X_4$, and to the address drivers XA1 to XA4 consisting of the complementary transistor pairs $Q_1$, $Q_2$ of the pnp and npn types connected in series between the floating power supply line on the high potential side (2nd power supply line) 11 and the floating power supply line on the low potential side (1st power supply line) 12. The power supply line 12 is connected to the voltage change-over circuit 13 which consists of the complementary transistor pair $Q_3$, $Q_4$ being connected in series between the DC power supply Vna of the non-display voltage level and the reference ground voltage Vg and also connected respectively to the data electrodes $X_1$ to $X_4$ via the separation diodes $D_2$. In addition, the 2nd power supply line 11 is connected with the address voltage source $\Delta Va$ between the 1st power supply line so that it is always kept higher than the 1st power supply line 12 by a voltage $\Delta Va$ corresponding to a difference between the display voltage Va and the non-display voltage Vna.

Thus, when considering the X side data electrode group 6, the 1st power supply line 12 receives two voltage levels, the reference ground voltage Vg or the non-display voltage Vna in accordance with the ON or OFF state of the transistors $Q_3$, $Q_4$ of the voltage changeover circuit 13. When the non-display voltage Vna is selected, all data electrodes are clamped to the non-display voltage Vna through the diodes $D_2$. Therefore when the pnp transistor $Q_1$ of the address driver is turned ON under this condition, the display voltage Va is applied to the selected data electrodes in such a form that the address voltage $\Delta Va$ on the 2nd power supply line is superimposed on the non-display voltage Vna. In addition, when the npn transistor $Q_4$ of the voltage changeover circuit 13 is ON, the 1st power supply line 12 is set to the ground voltage Vg, and if the npn transistor $Q_2$ of the address driver is turned ON under this condition, the falling portion of the applied voltage pulse is formed via the discharge through the data electrode side.

Figure 9A:
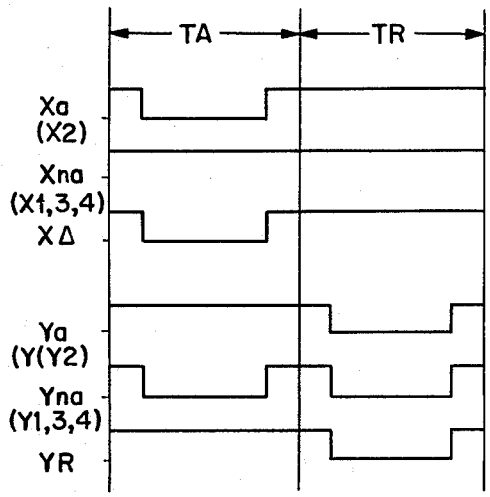
FIGS. 9*a*, 9*b* and 9*c* illustrate the input signal waveforms, waveforms applied to the electrodes, and waveforms applied to the display cells for the circuit of FIG. 8.
Figure 9B:
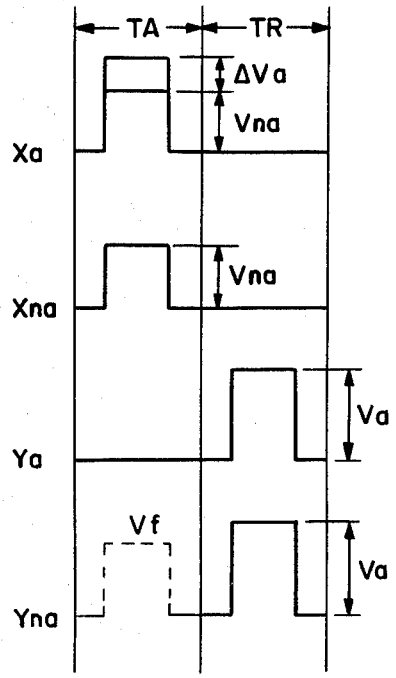
Figure 9C:
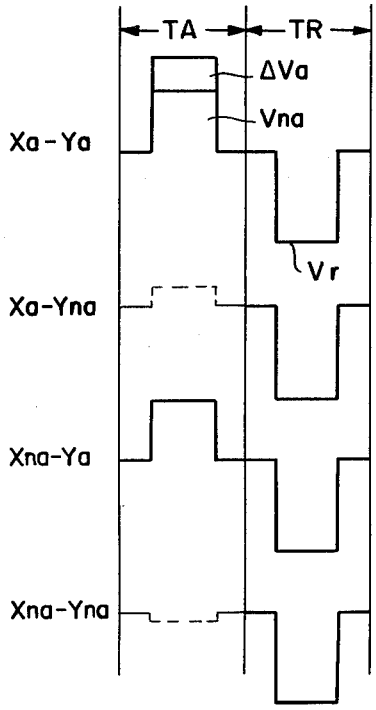

In the actual drive, the AC refresh drive method as explained at first is employed. Thereby scanning for a single display frame is carried out by sequentially applying the address signal for each line and thereafter the addressed point is capable of emitting the light when the refresh pulse is applied in common from the scanning electrode side. FIG. 9(*a*) shows the input signal waveforms for the drivers and transistors during the address period TA and the refresh period TR in such a case that the display cell $C_{22}$ at the intersecting point of the scanning electrode $Y_2$ and data electrode $X_2$ of FIG. 8 emits the light. Each waveform is given a symbol which is also given to the corresponding input terminal in FIG. 8. FIG. 9(*b*) shows the waveforms applied to the electrodes, while FIG. 9(*c*) the waveforms of voltages applied to the display cells.

With reference to FIG. 8 and FIG. 9, when a selected scanning electrode Ya, namely $Y_2$ is grounded through the grounding transistor QS2, the display voltage $Vna+\Delta Va$ appearing on the selected data electrode Xa, namely $X_2$, is applied to the display cell, namely the cell $C_{22}$, at the point $X_a$-$Y_a$ to be selected on the selected line through the pnp transistor $Q_1$ of the address driver XA2 as shown in FIG. 9(*c*). During this period, as is obvious from the waveforms shown in FIG. 9(*b*), the non-selected data electrodes Xna, namely $X_1$, $X_3$ and $X_4$, are clamped to the non-display voltage Vna of 150 V supplied via the 1st power supply line 12 through the diodes $D_2$. Therefore, a floating voltage Vf between the display voltage Va of 200 V and non-display voltage Vna of 150 V in accordance with the number of selected data electrodes is induced on the floating non-selected scanning electrodes Yna, namely $Y_1$, $Y_3$ and $Y_4$. As a result, as shown in FIG. 9(*c*), when the display voltage pulse of 200 V is applied to the display cells of the selected point Xa-Ya on the selected scanning line, the non-display voltage of 150 V is applied to the cells of the half-selected points Ya-Xna on the scanning line, namely the selected scanning electrode Ya. But, only a maximum voltage of 50 V is applied to the cells of the half-selected points Xa-Yna on the selected data electrode Xa which occupy the majority of the remaining cells and the cells of the non-selected points Xna-Yna. In this case, the voltages which appear at each area of the display screen in this condition are as in the case of FIG. 5 as explained previously.

In the actual operation, after the scanning for adding in parallel the display voltage to the address data for a single display screen for each scanning electrode from the X side data electrodes, the refresh voltage pulse $V_r$ equivalent to the display voltage Va is applied from the transistor $Q_{yr}$ as the refresh driver connected in common to the Y side scanning electrode. Thus, the operations for the display of a single frame terminate in the refresh period TR where the refresh voltage pulse Vr is applied, and all data electrodes $X_1$ to $X_4$ are connected to the 1st power supply line 12 through the npn transistor $Q_2$ in the low voltage side of address driver and connected to the ground potential $v_g$ via the npn transistor $Q_4$ of the voltage change-over circuit 13.

In this case, a voltage difference between the 1st and 2nd power supply lines does not change even when the voltage of the 1st power supply line 12 is changed over between the level of non-display voltage Vna and the ground potential Vg. Therefore the address driver not required to switch an address voltage of more than 50 V or so, indicated as ΔVa. Thus, the problem of switching the high display and float voltage is solved even when the address drivers XA1 to XA4 in the data electrode side are formed with the CMOS IC.

In summary, explained above is an embodiment disclosing subject matter wherein a non-display voltage Vna lower than the display threshold voltage is applied to the non-selected data electrodes and simultaneously the selected display cells are driven while the non-selected scanning electrodes are in the floating condition. However, it is effective to clamp the non-selected scanning electrodes to an interim voltage Vnm expressed as Vnm=Vna+(Va−Vna)/2 in order to minimize the voltage applied to the display cells of the half-selected points.

Figure 10:
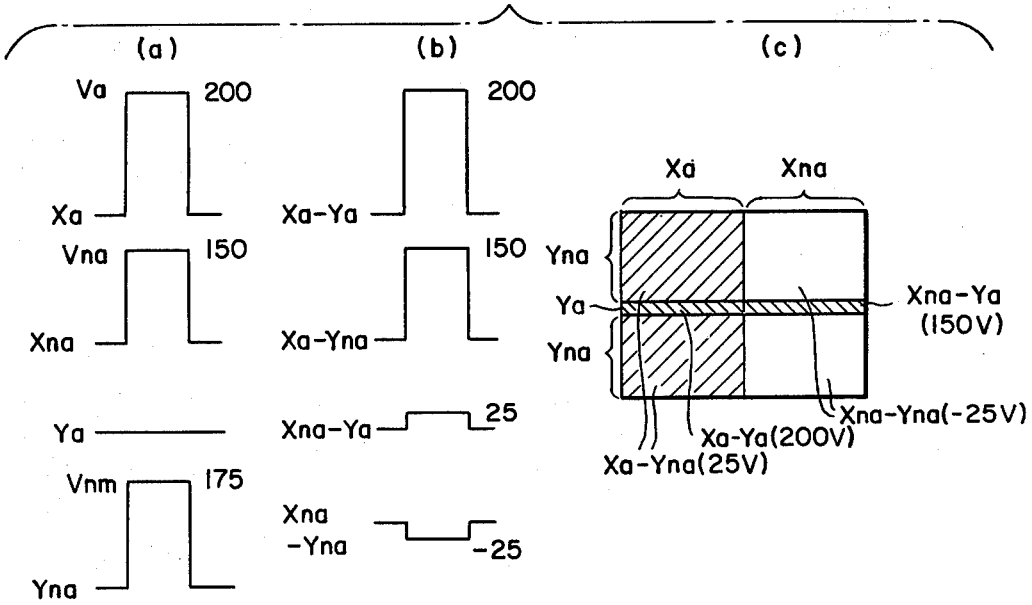
FIGS. 10*a*, 10*b* and 10*c* illustrate the voltage waveforms applied to the electrodes, voltage waveforms applied to the display cells, and voltages applied to cells of the display screen in accordance with the third embodiment of the present invention.

FIGS. 10(*a*), (*b*) and (*c*) show the waveforms of voltages and distribution of applied voltages for explaining other embodiments for example, the embodiment applying $V_{nm}$ to the non-selected scanning electrodes.

With reference to FIG. 10(*a*), a display drive pulse Va of 200 V based on the data corresponding to the line of selected scanning electrode Ya being clamped to the reference ground potential, is applied to the selected data electrode X, while the non-selected data electrode Xna and the non-selected scanning electrodes are respectively maintained at the voltages Vna of 150 V and Vnm of 175 V. Because of the brightness characteristics of FIG. 4 as explained above, the voltage Vna of 150 V applied to the non-selected data electrodes is given as the maximum voltage corresponding to the point where the brightness LD which is insufficient for giving the display effect, and the voltage 200 V of the display drive pulse Va is set as the voltage which yields the saturated brightness LS per FIG. 4. In addition, the value of the intermediate voltage Vnm of 175 V which is applied to the non-selected scanning electrode Yna is selected by adding a half of the difference between Va and Vna to the Vna.

Thus, as is obvious from FIGS. 10(*b*) and (*c*), when the display drive voltage of 200 V is applied to the display cells of selected points Xa-Ya on the scanning line, the non-display voltage of 150 V is applied to the cells of the half selected points Ya-Xna on the selected scanning line, namely the selected scanning electrode Ya, but only a voltage of 25 V corresponding to a voltage difference between both electrodes is applied to the cells of the half-selected points Xa-Yna and those on the selected data electrode Xa which occupy the majority of the remaining cells and the cells of non-selected points Xna-Yna. Moreover, the voltage of 25 V is equally applied on the cells other than those of the scanning lines without relation to the number of selected data electrodes and therefore fluctuation of power consumption is minimized.

Figure 11:
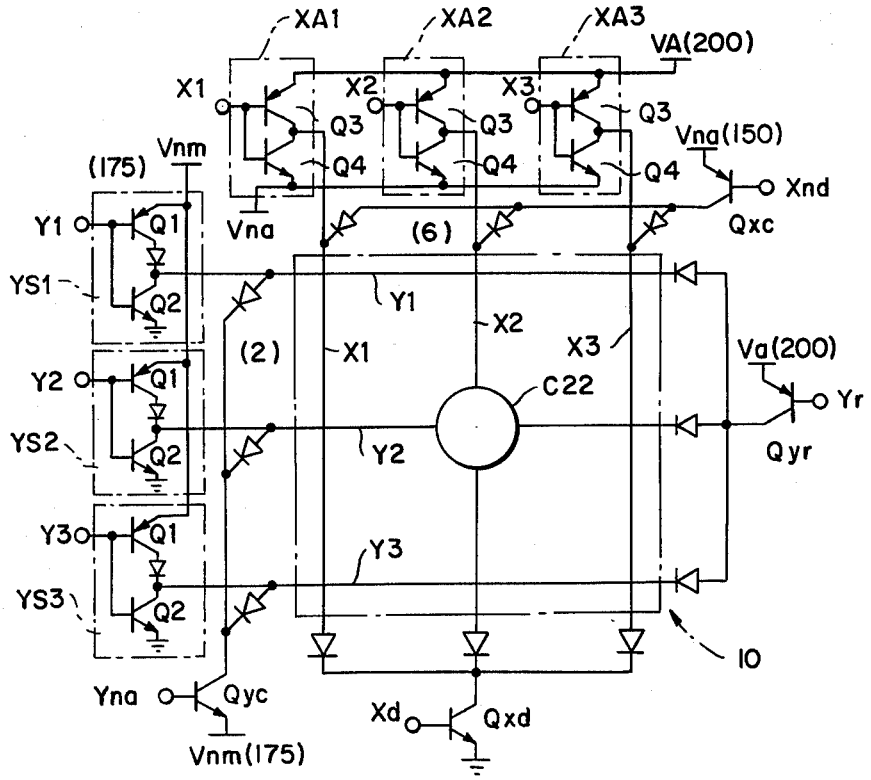
FIG. 11 shows an example of a circuit structure for the third embodiment of the present invention.

FIG. 11 outlines an example of a circuit structure for realizing the abovementioned drive method. The electrodes $Y_1$ to $Y_3$ of the Y side scanning electrode group 2 of the EL display device 10 explained previously in regard to FIG. 1, are respectively connected to the scanning drivers YS1 to YS3 comprising the pnp and npn transistor pairs $Q_1$, $Q_2$ connected in series between the power supply Vnm of 175 V and ground. Moreover, this scanning electrode group 2 is also connected with the transistor $Q_{yc}$ for clamping to an intermediate voltage Vnm in common via the separation diodes, while also connected in common with the refresh pulse supply transistor $Q_{yr}$ via separation diodes.

On the other hand, the X side data electrode group 6 is respectively connected with the address drivers XA1 to XA3 comprising the pnp and npn transistor pairs $Q_3$, $Q_4$ which are connected in series between the display level Va of 200 V and non-display level Vna of 150 V. In addition, to this data electrode group, the transistor $Q_{xc}$ for clamping to the non-display voltage Vna and the transistor $Q_{xd}$ for grounding are respectively connected in common via separation diodes.

Figure 12A:
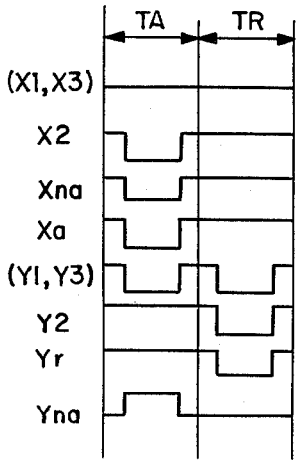
FIGS. 12*a*, 12*b* and 12*c* illustrate the input signal waveforms, waveforms applied to electrodes, and waveforms applied to the display cells for the circuit of FIG. 11.
Figure 12B:
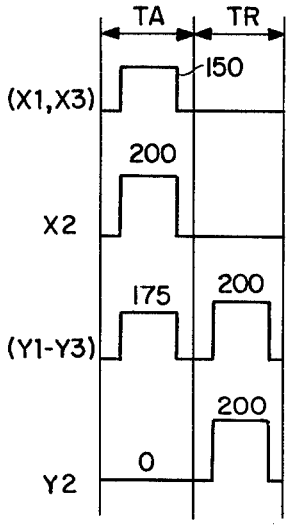
Figure 12C:
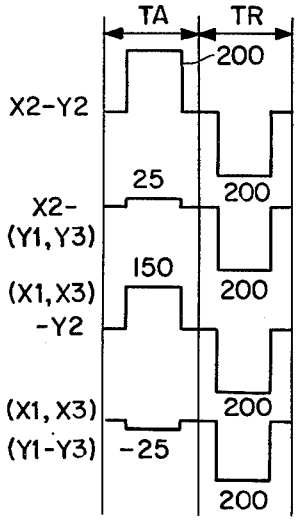

In actual drive, the AC refresh drive method as explained initially is employed, where the scanning for a single display frame is carried out by sequentially applying the address signals for each line and thereafter the refresh pulse is applied in common from the scanning electrode side, thereby the address point is capable of emitting the light. FIG. 12(*a*) shows the input signal waveforms for the driver and transistor during the address period TA and the refresh period TR in such a case as causing the cell $C_{22}$ at the intersecting point of the scanning electrode $Y_2$ and data electrode $X_2$ shown in FIG. 11 to emit the light. The waveforms are indicated by the symbols given to the corresponding input terminals of FIG. 11. FIG. 12(*b*) shows the waveforms of voltages applied to the electrodes, while FIG. 12(*c*) shows the waveforms of voltages applied to the display cells.

With reference to FIG. 11 and FIG. 12, when the display cells at the intersecting point of the scanning electrode $Y_2$ and data electrode $X_2$ is selected, the display drive pulse of 200 V is applied to the selected cells from the transistor $Q_3$ of the address driver XA2 toward the grounding transistor $Q_2$ of the scanning driver YS2. At this time, in the scanning electrode side, all of the non-selected scanning electrodes $Y_1$, $Y_3$ are clamped to an intermediate voltage of 175 V through the non-selected scanning drivers and the clamping transistor $Q_{yc}$. On the other hand, the non-selected electrodes in the data electrode side are also respectively clamped to the non-display voltage of 150 V via the non-selected address drivers and the clamping transistor $Q_{xc}$. Therefore, a charging current in accordance with a voltage difference of 25 V flows to the clamp source of 175 V from the drive source of 200 V of the address driver XA2 via the common clamp transistor $Q_{yc}$ in the scanning electrode side flows into the half-selected points on the selected data electrode $X_2$, while a charging current, which flows into the power source of 150 V from the intermediate voltage of 175 V of the non-selected scanning drivers YS1 and YS3 through the transistor $Q_4$ in the low voltage side of the non-selected address drivers XA1, XA3 in the data electrode side, is applied to the discharge cells of non-selected points.

However, since a charging/discharging current flowing into these half-selected points and non-selected points depends only on a voltage difference of 25 V, the power loss is comparatively small. In addition, such a power loss changes very little even when the number of selected data electrodes changes.

In the above embodiments, the non-display voltage Vna is applied to the non-selected electrodes on the data electrode side and the non-selected scanning electrodes are maintained at a predetermined voltage higher than the voltage of the floating condition or the reference voltage. However, the same effect can substantially be obtained even when the conditions of voltages for these non-selected electrodes are reversed. Namely, it should be understood that it is also possible to set the non-selected data electrodes to the floating condition and apply the non-display voltage Vna to the non-selected scanning electrodes.

As explained previously in regard to FIG. 1, the electrode 2 in the side of substrate 1 of the EL device is generally formed with the transparent conductive film in order to observe the display through the glass substrate. This transparent electrode layer is usually composed of tin oxide ($SnO_2$), or indium oxide ($In_2O_3$) or their compounds, which inevitably shows a higher electrode resistance as compared with the rear side electrode 6 consisting of the aluminium film. For example, the transparent electrode consisting of the tin oxide film has an area resistance of about 10 ohms/sq and results in electrode resistances of several tens K-ohms as the display screen becomes large. For this reason, when the drive voltage pulse is supplied through the electrode having such resistance, the time constant of drive circuit becomes large since the display cells to be driven are capacitive, and resultingly the rising edge of the pulse waveform has some roundness. The brightness characteristic of the AC drive type EL display device of this kind tends to largely depend on the rise time of the drive pulse and is lowered as the rise time becomes long. On the other hand, such EL display device results in a problem that it is required to widen the pulse width in order to obtain the required brightness and thereby the write address speed is lowered.

Here, the inventors of the present invention have found that the influence of electrode resistance can be effectively suppressed by supplying the display drive pulse from the side of the transparent electrode than supplying it from the side of metallic rear side electrode.

Figure 13A:
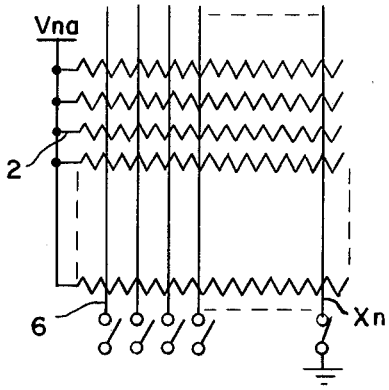
FIGS. 13*a* and 13*b* illustrate the effect of electrode resistance upon the display drive pulse.
Figure 13B:
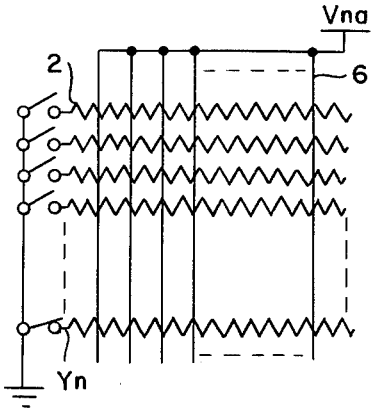

Refering now FIGS. 13(*a*), (*b*), it will be explained regarding the rise time of the pulse voltage rising toward the voltage level $V_{na}$ in the both case where the side of supplying drive pulse is mutually reversed. In FIG. 13(*a*), the drive pulse is supplied from the side of resistive transparent electrode 2, while in FIG. 13(*b*), the drive pulse is supplied from the side of metallic rear side electrode 6.

Figure 14A:
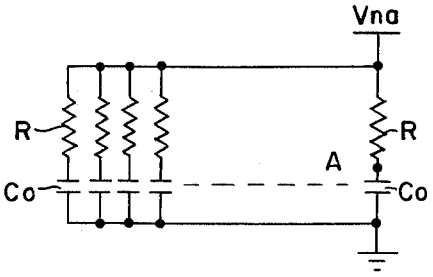
FIGS. 14*a* and 14*b* show the equivalent circuits for the drive techniques of FIG. 13.
Figure 14B:
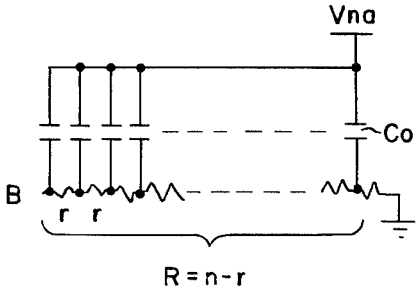

When considering the case where the right most X electrode Xn is grounded by the scanning circuit and all display cells on the line are driven in common by the selective drive circuit as shown in FIG. 13(*a*), the equivalent circuit in this case is indicated in FIG. 14(*a*). Meanwhile when considering the case where the lowest Y electrode Yn is grounded with the Y side transparent electrode 2 used as the scanning electrode and all of the X side metallic rear side electrodes are selected and the drive pulse is supplied in common thereto, the equivalent circuit is indicated in FIG. 14(*b*). In FIG. 14, R and r are respectively series resistance per single transparent electrode and a resistance between elements of the transparent electrodes, while $C_o$ is a capacitance of unit display cell.

In comparison with FIGS. 14(*a*) and (*b*), the time constant of the cell A of FIG. 14(*a*) is almost $R \cdot C_o$.

On the other hand, in the case of where a metallic rear side electrode is used as the data electrode, the equivalent circuit of it is a ladder type circuit including Co and n·r, as shown in FIG. 14(*b*). Here, in general, the time constant of the ladder type circuit is larger than the time constant R·Co of simple parallel circuit of FIG. 14(*a*).

Therefore, it is proved that the rise time of the pulse waveform can be reduced and distortion of the waveform can also be improved more effectively by supplying the drive pulse voltage from the side of the transparent electrode with the transparent electrodes used as the data electrode as shown in FIG. 13(*a*). Thus, on the occasion of introducing the thin film EL display device driving method as explained above, it is recommended to drive the transparent electrodes as the data electrodes and the metallic rear side electrodes as the scanning electrodes.

As will be obvious from the above explanation, the present invention is, in short, characterized in that the non-display voltage which is a little lower than the display threshold value is supplied to any one of the non-selected data electrodes and non-selected scanning electrodes, and simultaneously the display voltage is supplied to the selected display cells whle the other non-selected electrodes are sustained at a voltage higher than the reference voltage. Employment of this driving method brings about advantages in that the unnecessary power consumption at the half-selected display cells can be reduced and a wider operating voltage range can be set because the risk of errorneous display can be removed even when the display voltage pulse level is set to a higher level.

Therefore, the present invention is very effective when i t is adapted to the method for driving the matrix type display device comprising the capacitive display cells such as the thin film EL display device.

What is claimed is:

1. A method for driving a matrix type display device for generating an electric-optical display effect in accordance with a display voltage being higher than a non-display voltage which is higher than a reference voltage, comprising a display medium layer, matrix type scanning electrodes and data electrodes, each having a selected and a non-selected state being disposed on opposite sides of and capacitively coupled with said display medium layer, said scanning and data electrodes overlapping and defining capacitive display cells at the overlapping points provide the electric-optical display effect by applying the display voltage of a predetermined level from said both electrodes to the capacitive display cells, said method comprising the steps of:

(a) selecting and applying the reference voltage to at least one of the scanning electrodes;

(b) selecting and applying the display voltage to at least one of the data electrodes;

(c) applying the non-display voltage, which is insufficient for giving the display effect, to an electrode group selected from the non-selected data electrodes and the non-selected scanning electrodes; and (d) simultaneously permitting the voltages of the remaining non-selected electrodes group to rise to a voltage higher than said reference voltage.

2. A method for driving a matrix type display device according to claim 1, wherein when selecting and applying the display voltage to the at least one of the data electrodes the remaining non-selected electrodes group is set to a floating condition and the voltages of the remaining non-selected delectrodes group are sustained at a level higher than the reference voltage through the capacitive coupling with the first one of the non-selected electrodes group.

3. A method for driving a matrix type display device according to claim 1, wherein when selecting and applying the display voltage to the at least one of the data electrodes the remaining non-selected electrodes group is clamped to a voltage which is higher than the level of said non-display voltage but lower than the level of said display voltage.

4. A method for driving an EL (electroluminesence) display device including a matrix type EL display device having a display threshold voltage which comprises an EL layer, a scanning circuit operatively connected to said EL display device, an address drive circuit operatively connected to said EL display device, matrix type transparent row electrodes, disposed on a first side of said EL layer and having a selected and nonselected state, and metallic column electrodes each having a selected and a nonselected state disposed on a second side of and capacitively coupled with said EL layer, said row electrodes and said column electrodes overlapping and defining capacitive El display cells at said overlapping points, and said row and column electrodes providing a predetermined level to the EL display cells, said method comprising the steps of:

(a) providing one of the row electrodes and the column electrodes as scanning electrodes;

(b) providing the remaining electrodes as the data electrodes;

(c) selecting sequentially and clamping at least one of the selected scanning electrodes to a reference voltage;

(d) simultaneously placing the non-selected scanning electrodes connected to the scanning circuit in the floating condition;

(e) selecting and applying the display voltage to at least one of the data electrodes; and (f) simultaneously applying a non-display voltage which is lower than the display threshold voltage of said EL display cells to the non-selected data electrodes connected to the address drive circuit.

5. A method for driving an EL display device according to claim 4, wherein said metallic column electrodes correspond to the scanning electrodes connected to the scanning circuit, while said transparent row electrodes correspond to the data electrodes connected to the address drive circuit.

6. A driving circuit for driving a matrix type display device for generating an electric-optical display effect in accordance with a predetermined display voltage, comprising:

a display medium layer;

matrix type scanning electrodes and data electrodes, each of said scanning electrodes and data electrodes having a selected and non-selected state, being disposed on opposite sides of and capacitively coupled with said display medium layer, and overlapping at predetermined positions defining capacitive display cells, said scanning and data electrodes providing the electric-optical display effect by providing the predetermined display voltage to the capacitive display cells defined at the interreacting points of both electrodes;

a scanning driver operatively connected to said scanning electrodes and to receive a reference voltage, for selectively and sequentially connecting the scanning electrodes to the reference voltage;

a first power source line operatively connected to selectively receive a non-display voltage level which is insufficient to provide said display effect, and the reference voltage;

a second power source line operatively connected to receive a voltage higher than said first power source line voltage by an amount corresponding to a voltage difference between said predetermined display voltage and said non-display voltage; and an address driver including a pair of switching elements operatively connected to said first and second power source lines, to the data electrodes and to receive an address voltage, for selectively connecting the data electrodes to said first and second power source lines in response to said non-selected and selected states of said data electrodes, respectively, connecting the data electrodes, to be placed in said selected state, to the second power source line through said address driver in accordance with the scanning electrodes sequentially selected by said scanning driver being connected to the reference voltage, and applying the predetermined display voltage to the display cells located at the overlap of the selected data electrode and the selected scanning electrode, the address voltage corresponding to said voltage difference and being superimposed on the non-display voltage on the first power source line in response to said address driver connecting the data electrodes in the selected state to the second power source line.

7. A driving circuit for driving a matrix type display device being operatively connected to receive select signals and address signals, having a display medium, matrix scanning and data electrodes for providing a predetermined display voltage, each of said scanning and data electrodes having a select and non-select state, said scanning electrodes being disposed on a first side of said display medium and along a first specified direction, said data electrodes being disposed on a second side of said display medium and along a second specified direction, portions of said data electrodes overlaying portions of said scanning electrodes at predetermined positions defining capacitive display cells at said predetermined positions and being capacitively coupled to said overlying portions of said scanning electrodes and data electrodes, said driving circuit comprising:

scanning driver means, operatively connected to receive a reference voltage and said select signals, for providing said reference voltage to respective of said scanning electrodes in accordance with said select signals, and for providing a non-select voltage to the remaining of said scanning electrodes;

address driver means, operatively connected to said data electrodes and to receive said address signals, a first voltage lower than said predetermined display voltage, and a second voltage higher than said first voltage by an amount corresponding to the voltage difference between said predetermined display voltage and said first voltage, for selectively providing said first and second voltages to said data electrodes in accordance with said address signals.

8. A driving circuit for driving a matrix type display device according to claim 7, wherein said scanning driver means comprises a plurality of transistors each having a collector, a base, and an emitter, respective of said transistors having said base operatively connected to receive corresponding of said select signals, said collector operatively connected to corresponding of said scanning electrodes, and said emitter operatively connected to receive said reference voltage.

9. A driving circuit for driving a matrix type display device according to claim 8, wherein said scanning driver means further comprises means for receiving a clamping voltage higher than said first voltage and lower than siad second voltage, and for providing said clamping voltage to said scanning electrode in accordance with said select signals and said non-select state of said scanning electrodes.

10. A driving circuit for driving a matrix type display device according to claims 7 or 9, wherein said address driver means comprises a plurality of switching means, each operatively connected to receive said first and second voltages, respective of said switching means being operatively connected to corresponding of said data electrodes and to receive corresponding of said address signals, said switching means selectively providing said first and second voltages to said data electrodes in accordance with said address signals.

11. A driving circuit for driving a matrix type display device according to claim 10, wherein each of said switching means comprises a pair of first and second transistors, each having a collector, a base and an emitter, the base of said first transistor being operatively connected to the base of said second transistor and to receive said corresponding address signal, the collectors of said first and second transistors being operatively connected to said corresponding data electrode, and the emitter of said first transistor being operatively connected to receive said second voltage and the emitter of said second transistor being operatively connected to receive said first voltage.

12. A driving circuit for driving a matrix type display device according to claim 11, wherein said device further comprises a power supply having a positive terminal operatively connected to the emitter of each of said first transistors and a negative terminal operatively connected to the emitter of each of said second transistors, and wherein the emitter of each of said second transistors is operatively connected to receive said first voltage.

13. A method for driving a matrix type display device operatively connected to receive a reference voltage, for generating an electric-optical display effect in accordance with a display voltage being higher than a non-display voltage which is higher than the reference voltage, comprising a display medium layer, matrix type scanning electrodes and data electrodes, each having a selected and a non-selected state, and being disposed on opposite sides of and capacitively coupled with the display medium layer, and overlapping and defining capacitive display cells at the overlapping points, said method comprising the steps of:

(a) selecting and applying the reference voltage to at least one of the scanning electrodes;

(b) selecting and supplying the display voltage to at least one of the data electrodes;

(c) applying the non-display voltage being less than the display voltage to an electrode group selected from the non-selected data electrodes and the non-selected scanning electrodes; and (d) simultaneously permitting the voltages of the remaining non-selected electrodes group to rise to a voltage higher than the reference voltage.

* * * * *

UNITED STATES PATENT AND TRADEMARK OFFICE

CERTIFICATE OF CORRECTION

PATENT NO. : 4,456,909

DATED : June 26, 1984

INVENTOR(S) : Takahara et al.

It is certified that error appears in the above-identified patent and that said Letters Patent is hereby corrected as shown below:

Column 2, line 42, "ponts" should be --points--.
Column 5, line 44, delete "to".
Column 7, line 31, delete "where" insert --, during which--;
line 41, after "driver" insert --is--.
Column 12 , line 31, "interracting" should be --intersecting--.

Signed and Sealed this

*Eighteenth* Day of *December 1984*

[SEAL]

*Attest:*

GERALD J. MOSSINGHOFF

*Attesting Officer*

*Commissioner of Patents and Trademarks*